United States Patent [19]

Capolupo et al.

[11] 4,379,644

[45] Apr. 12, 1983

[54] TIMEPIECE CASE/DIAL PLATE ASSEMBLY

[75] Inventors: David F. Capolupo, Oakville; James J. Donnelly, Wolcott, both of Conn.

[73] Assignee: Timex Corporation, Waterbury, Conn.

[21] Appl. No.: 271,499

[22] Filed: Jun. 8, 1981

[51] Int. Cl.[3] ..... G04B 37/00

[52] U.S. Cl. ..... 368/314; 368/276; 368/294

[58] Field of Search ..... 368/314, 294, 295, 228, 368/232, 236, 276

[56] References Cited

U.S. PATENT DOCUMENTS 3,525,210 8/1970 Nakamura ..... 368/276
4,241,442 12/1980 Grohoski ..... 368/314 X

FOREIGN PATENT DOCUMENTS 621666 2/1981 Switzerland ..... 368/276
2029609 3/1980 United Kingdom ..... 368/276

*Primary Examiner*—Ulysses Weldon
*Attorney, Agent, or Firm*—William C. Crutcher

[57] ABSTRACT

The assembly includes a timepiece case having an undercut portion forming a maneuvering recess for a dial plate which is oversized in one dimension relative to an access opening in the case. The maneuvering recess allows a dial plate larger in one dimension than the access opening to be inserted into the case. A larger, more aesthetically-pleasing dial plate can thereby be employed while retaining an appearance of thinness for the timepiece case.

2 Claims, 4 Drawing Figures

TIMEPIECE CASE/DIAL PLATE ASSEMBLY

FIELD OF THE INVENTION

The present invention relates to timepiece construction and, in particular, to a dial plate/case assembly.

BACKGROUND OF THE INVENTION

The current effort in watch styling is to develop timepieces having a thin look. Essential in achieving this thin look is to use watch cases which are either in fact thin or present the appearance of thinness.

One technique which has been used in the past to provide a watch case with a thin appearance when worn on the wrist has been to relocate rear case features which add to the case thickness inwardly away from the case periphery and out of view of the wearer when the watch is on the wrist. For example, FIG. 1 shows a watch case embodying this technique in that the rear side (wrist-side) 2*a* of the case 2 includes a rearwardly-projecting wall 2*b* disposed inwardly away from the periphery of the rear side to define as access opening 2*c* in the back of the case through which a movement/dial plate assembly can be inserted into the case with the dial plate seating on annular lip 2*d*. Although this type of case construction has proved successful in providing an appearance of thinness when the watch is worn, it suffers from the disadvantage that the size of the access opening in the rear side of the case is reduced and this, in turn, restricts the size of dial plate which can be inserted through the access opening. Since another present trend in watch styling is toward larger-sized dials in conjunction with thinner appearance, the case construction technique described does not provide optimum flexibility in watch styling.

SUMMARY OF THE INVENTION

It is an object of the invention to provide a watch, clock or other timepiece case with a uniquely designed interior which enables a movement assembly with a dial plate larger than the access opening in the case to be maneuvered into the case.

It is another object of the invention to provide such a timepiece case without any sacrifice in the appearance of thinness.

Briefly stated, the present invention provides a timepiece case which includes at least one interior undercut portion forming a maneuvering recess in the inner wall of the case to receive a dial plate oversized in one dimension relative to the access opening in the case. Preferably, an undercut portion is provided in facing interior walls of the timepiece case, defining a pair of opposed, facing maneuvering recesses for the oversized dial dimension. The dial plate rests on an annular seat in the case interior after insertion.

Insertion of the dial plate is effected simply by tilting the dial plate relative to the access opening and inserting a portion of the dial plate in the direction of the oversized dimension into the maneuvering recess to accommodate the oversize and allow the remainder of the dial plate in that direction to be passed through the access opening.

DESCRIPTION OF PREFERRED EMBODIMENTS

Figure 1:
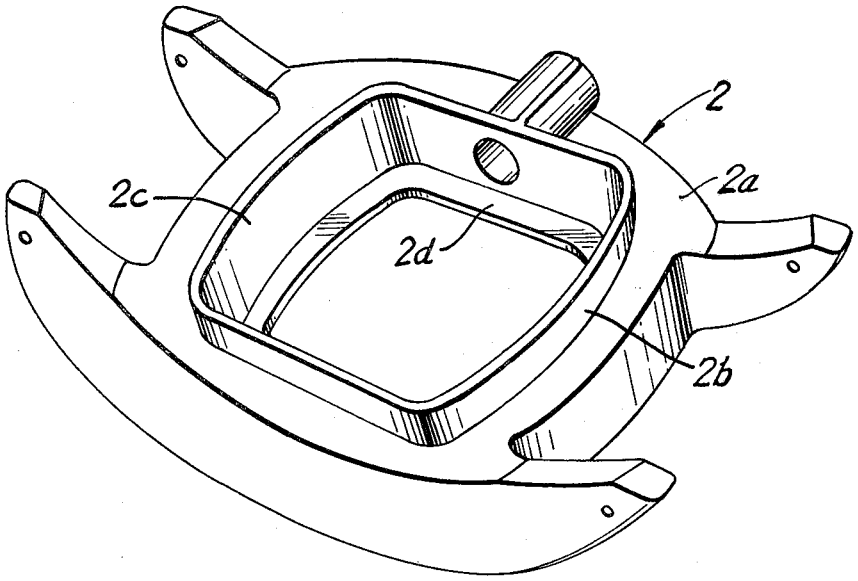
(PRIOR ART) FIG. 1
FIG. 1 is a bottom perspective view of a typical prior art watch case given a thinner appearance.
Figure 2:
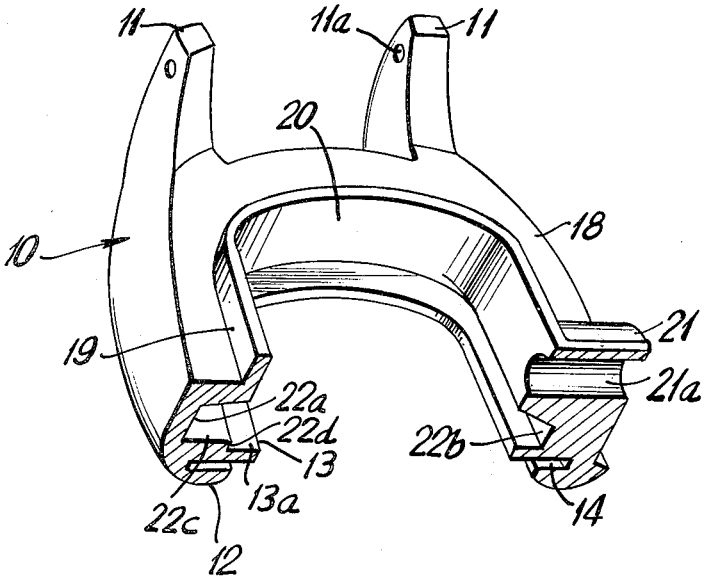
FIG. 2 is a perspective view of the watch case of the invention through its midsection along line A—A of FIG. 3.
Figure 3:
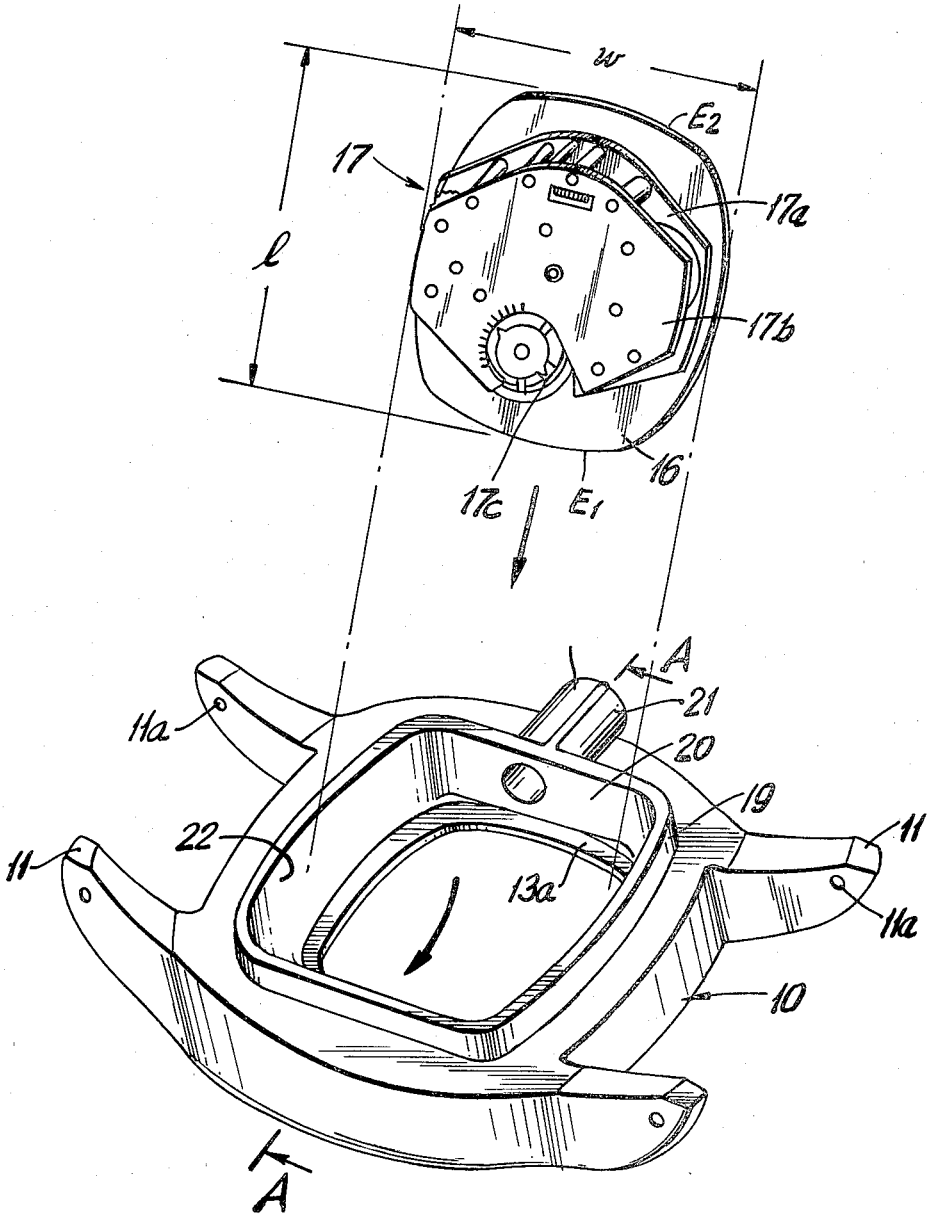
FIG. 3 is a perspective view of the watch case of the invention and the movement assembly tilted for insertion into the watch case.

A watch case embodying the present invention is illustrated in FIGS. 2 and 3. The case (also sometimes referred to as a bezel) includes a forged, diecast, molded or machined body 10 having a pair of spaced apart lugs 11 on opposite sides between which a watch strap or band is attached in well-known manner, e.g. by a spring bar having its ends received in lug holes 11*a*.

Figure 4:
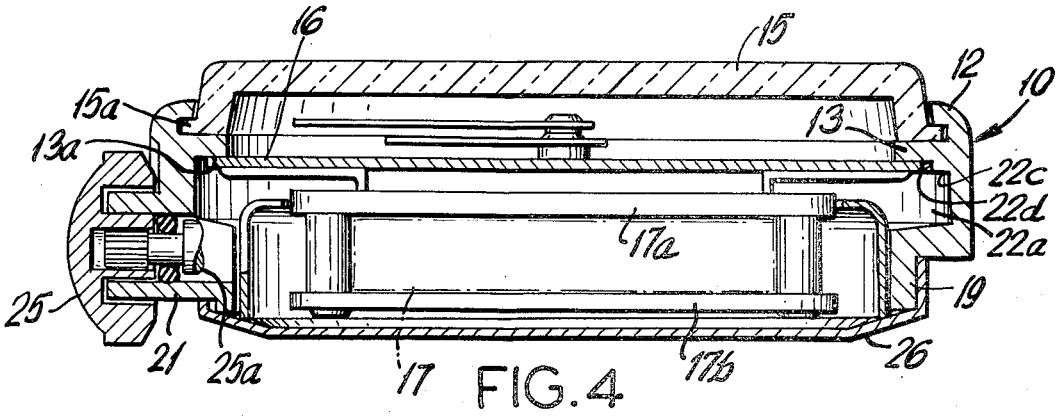
FIG. 4 is a partial cross-section through the case with the movement and dial plate therein and the crown and caseback attached.

The front side of the case includes an inwardly-extending first flange 12 and second flange 13 which define therebetween an annular slot 14 to receive the annular flange 15*a* of transparent crystal 15 in well-known fashion, FIG. 4. The second flange 13 includes a rear-facing annular seating surface 13*a* on which the dial plate 16 rests in well-known fashion when the movement 17 and dial plate are disposed within the case as described hereinafter.

The rear side of the case includes a rear surface 18 from which a wall 19 projects defining an access opening 20 in the rear side of the case. The movement 17 with dial plate 16 attached is inserted into the case through this access opening as described hereinafter. A more or less cylindrical member 21 connects to the wall 19 at one side and includes a longitudinal passage 21*a* therethrough for receiving the stem 25*a* of the watch crown 25 (FIG. 4) in conventional fashion. Of course, the stem engages suitable gear means in the movement for setting time, date and like.

The movement 17 is of conventional construction and includes front and rear support frames 17*a* and 17*b* between which the timepiece gear train (not shown) and coil spring 17*c* are disposed. Fastened to the front support frame 17*a* is the dial plate 16. As mentioned hereinabove, an object of the invention is to accommodate a dial plate oversized in one dimension (relative to access opening 20) to enhance the overal aesthetic appearance of the watch. To this end the dial plate has a first plan width dimension, w, (FIG. 3) adapted to fit inside the corresponding plan width dimension of the access opening 20 and has a second plan length dimension, l, (FIG. 3) which is oversized relative to the corresponding plan length dimension of the access opening. That is, the length of the dial plate is greater than the length of access opening 20 in plan. For example, the width, w, and length, l, of a dial plate have been selected as 0.7323 inch whereas the corresponding dimensions of access opening 20 have been selected as 0.755 inch and only 0.690 inch, respectively.

A important feature of the invention is that the interior wall 22 of the case defines not only a main chamber for receiving the movement and dial plate but also defines an undercut portion on opposite, facing sides of the chamber to form maneuvering recesses 22*a* and 22*b* in which the oversized length of the dial plate is accommodated (FIG. 2). It is apparent that the extent of undercut of recess 22*a* is greater than that of recess 22*b* to allow the oversized length of the dial plate to pass through the access opening. These undercut portions are formed during machining of the interior wall of the case or by other known means. Of course, the size and shape of the recesses 22*a* and 22*b* are varied in relation to the size and shape of the dial plate and can be determined readily by those skilled in the art.

In the method aspect of the invention, the movement 17 and attached dial plate 16 are tilted for insertion through access opening 20 into the watch case. For example, as shown in FIG. 3 (arrows), the movement and dial plate are tilted at a suitable angle relative to the rear side of the case to insert end $E_1$ of dial plate 16 into maneuvering recess 22*a*. While end $E_1$ is thus inserted, the movement and dial plate are simply pivoted into the case through the access opening with end $E_2$ of the dial plate being received in maneuvering recess 22*b* and resting on seating surface 13*a* of flange 13. End $E_1$ of the dial plate is laterally maneuvered out of recess 22*a* onto seating surface 13*a* in final position, FIG. 4. The dial plate 16 thus seats and is retained entirely on surface 13*a*. A caseback 26 snap-fits onto wall 19 in conventional manner after insertion of the movement and dial plate to close-off the access-opening 20.

Recess 22*a* is shown as having a bottom surface 22*c* somewhat elevated relative to seating surface 13*a* to facilitate insertion of the movement and dial plate through the access opening. The intersection of bottom surface 22*c* and seating surface 13*a* provides an annular upright shoulder 22*d*. This arrangement is preferred since the shoulder 22*d* prevents significant lateral movement of dial plate 16 once it is positioned on seating surface 13*a* and also provides proper alignment of the dial plate relative to the crystal opening in the front of the case.

Although a more or less square shaped dial plate and rectangular access opening are illustrated herein, it will be understood that the invention is applicable to other shapes as well. And, it will be apparent that in certain situations it may be possible to employ only one maneuvering recess inside the case to accommodate the oversized dimension of the dial plate. Furthermore, while there have been described preferred embodiments of the invention, other changes or modifications may occur to those skilled in the art, and it is desired to cover in the appended claims all such modifications as fall within the time spirit and scope of the invention.

We claim:

1. In a timepiece, the combination of:

a. a non-circular dial plate having a first plan dial plate dimension and second plan dial plate dimension, and b. a case for housing the dial plate, said case having a rear surface with a projecting wall defining an access opening, an inner wall defining an interior chamber in communication with the access opening and a front wall defining an annular seat extending into the chamber and on which the dial plate rests in the chamber, said access opening having a first plan dimension larger than the corresponding first plan dial plate dimension and a second plan dimension smaller than the corresponding second plan dial plate dimension such that the dial plate is oversized in the second plan dimension, said case having an undercut portion in the direction of the second plan dimension of said access opening defining a maneuvering recess for the dial plate, whereby the second plan dimension of said dial plate can be inserted through the access opening by tilting the dial plate relative to the access opening and inserting a portion of the dial plate along the second plan dimension in the maneuvering recess to thereby accommodate the oversize in the second plan dimension and allow the remainder of the dial plate along the second dimension to be pivoted through the access opening.

2. The combination of claim 1 wherein the case is undercut on opposite, facing sides of the chamber defining first and second facing maneuvering recesses for the dial plate.

* * * * *